United States Patent [19]

Irmscher et al.

[11] Patent Number: 4,571,250

[45] Date of Patent: Feb. 18, 1986

[54] ASH CONTAINER

[76] Inventors: Edward Irmscher, Star Rt., Hortonville, N.Y. 12745; Jesse L. Colodner, 322 Orangeburg Rd., Pearl River, N.Y. 10965

[21] Appl. No.: 621,211

[22] Filed: Jun. 15, 1984

[51] Int. Cl.[4] ..... B01D 46/44; B65D 51/18

[52] U.S. Cl. ..... 55/359; 55/417; 55/429; 55/431; 55/469; 141/93; 220/1 T; 220/254; 232/44

[58] Field of Search ..... 55/357, 359, 385 C, 55/385 R, 417, 429, 431, 439, 469, 472; 220/1 T, 254, 408; 98/115 R; 232/44; 141/93; 417/470, 471

[56] References Cited

U.S. PATENT DOCUMENTS

| | | | |
|---|---|---|---|
| 868,894 | 10/1907 | Stephenson | 220/254 |
| 951,808 | 3/1910 | Frank | 55/429 |
| 1,045,950 | 12/1912 | Cramer | 55/469 X |
| 1,160,820 | 11/1915 | Baur | 220/408 X |
| 1,466,167 | 8/1923 | Holden | 55/418 X |
| 2,013,498 | 9/1935 | McConaughy | 98/115 R X |
| 2,602,417 | 7/1952 | Medcalf | 98/115 R X |
| 2,788,085 | 4/1957 | Waller | 55/357 |
| 3,343,199 | 9/1967 | Nolte | 55/431 X |
| 3,736,728 | 6/1973 | Kleissler, Jr. | 55/429 X |
| 3,908,720 | 9/1975 | Garnett | 141/93 |
| 4,360,947 | 11/1982 | DeCosa et al. | 55/359 X |

FOREIGN PATENT DOCUMENTS

| | | | |
|---|---|---|---|
| 674262 | 11/1963 | Canada | 232/44 |
| 718049 | 1/1932 | France | 55/385 R |
| 2275384 | 1/1976 | France | 98/115 R |
| 2592 | of 1908 | United Kingdom | 55/469 |

*Primary Examiner*—Kathleen J. Prunner

[57] ABSTRACT

This ash receiving device is designed to prevent ash dust from entering a room when ashes from a fireplace or wood stove are dumped into the device. Primarily, the device consists of a container with a removable ash receiving receptacle on its interior. It also includes a foot pedal operated vacuum producing mechanism in its base, which by an attached hose, will cause outside air to be drawn through openings through an internal chute in which the ashes are dumped to fall in the receptacle. This incoming air being drawn in by suction, pulls the ash dust produced when dumping, into a removable filter included in the chute.

9 Claims, 3 Drawing Figures

ASH CONTAINER

This invention relates to receptacles for receiving disposed of materials, and more particularly, to an ash container.

The principal object of this invention is to provide an ash container, which will be unique and novel, in that its design will be such, that it wil prevent wood ash dust from traveling through the room when cleaning a woodstove or fireplace.

Another object of this invention is to provide an ash container, which will be so designed, as to include in its structure, diaphragm means for producing a vacuum that will cause a differential in pressure to take place and prevent any ash dust from leaving the container.

Another object of this invention is to provide an ash container, which will be of such design, as to include a vented chute in its upper interior, for the receiving of the ashes, and filter means will also be employed in the chute, for preventing ash dust from entering the vacuum line attached to the chute.

A still further object of this invention is to provide an ash container, which will be so designed, as to include foot pedal means for manually producing the differential in pressure by diaphragm means, and check-valve means will be employed in the structure of the container, for control of the air flow.

Other objects of the invention are to provide an ash container, which will be simple in design, inexpensive to manufacture, rugged in construction, and easy to use.

These and other objects will become readilly understood, after a study of the specification and the accompanying drawing, in which.

Figure 1:
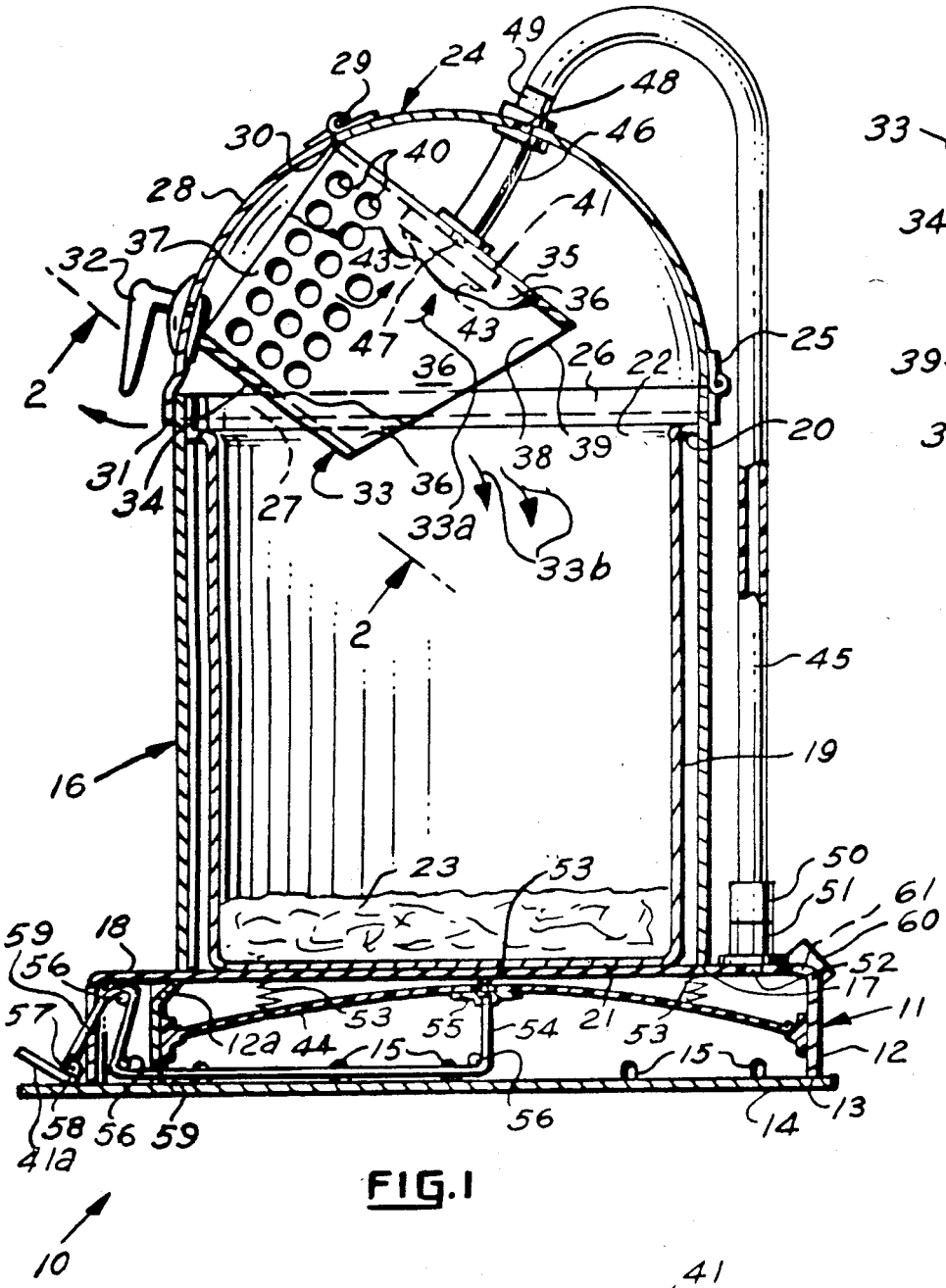
FIG. 1 is a side view of the present invention, shown in elevation and section.
Figure 2:
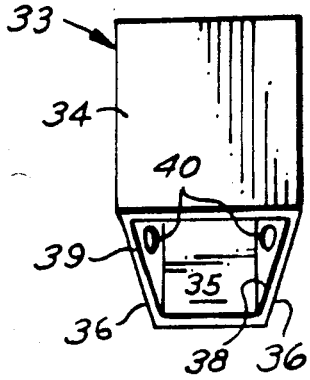
FIG. 2 is a view taken along the line 2—2 of FIG. 1, showing the chute.
Figure 3:
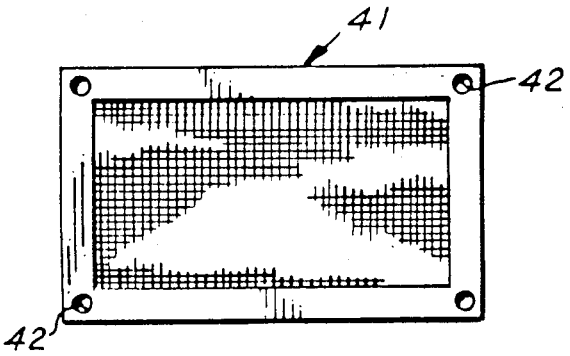
FIG. 3 is an enlarged front view of the filter, shown in elevation and removed from the invention.

Accordingly, an ash container device 10 is shown to include a base 11, having a diaphragm housing 12, which in this instance is of hollow cylindrical configuration, having its peripheral rim edge 13, fixedly secured in a suitable manner, to the top surface of a bottom plate 14. A plurality of equally spaced cut-out openings 15 are included through the rim edge 13, so as to provide air vent means into diaphragm housing 12, for the operation of vacuum producing means for device 10, which hereinafter will be described. A cylindrical container 16 is provided, and its bottom rim edge 17 is suitably fixedly secured to the top wall 18 of diaphragm housing 12. A hollow cylindrical ash receiving can or receptacle 19, includes an external and annular flange 20, which is integrally attached thereto, and the bottom wall 21 of receptacle 19, is also integrally attached to receptacle 19. The open end 22 of 19, serves to receive ashes 23 from a fireplace or a wood stove, and receptacle 19 is removable from container 16 for disposing of the ashes 23 received therein. The upper portion of container 16 is provided with a dome shaped cover 24, which is hinged to the top of container 16 by means of hinge 25, which is suitably fixedly secured to both cover 24 and container 16. Cover 24 is designed, so as to provide an air-tight or near air-tight seal for the open end 22 of receptacle 19 and the open end 26 of container 16, for the effective operation of device 10. A peripheral lip 27 on the bottom of cover 24, serves to aid in achieving the air-tightness necessary, by engaging with the outer peripheral surface of the upper portion of container 16. A door 28 is hinged to cover 24 by a hinge 29 at its upper end, which is suitably fixedly secured over opening 30 through cover 24, and door 28 also includes a lip 31, which engages with the outer periphery of container 16, to also aid in achieving the necessary air-tightness, abovedescribed. Door 28 further includes a handle 32, which is fixedly secured in a suitable manner, to the outside surface of door 28, so as to open door 28 to deposit the ashes 23 on the interior of receptacle 19.

An ash receiving chute 33 is provided on the interior of dome shaped cover 24, so as to facilitate the intended function of device 10, and chute 33 includes a front wall 34, a rear wall 35, and a pair of angular and inwardly disposed side walls 36. Chute 33 includes a top opening 37 and a bottom opening 38, and the open bottom rim 39 is truncated at an angle for the proper dropping of ashes 23 into the receptacle 19. Side walls 26 are suitably fixedly secured at their peripheral side edges, to the peripheral side edges of front wall 34 and rear wall 35. A plurality of spaced openings 40 are provided through side walls 36, so as to serve as air vents for the passage of air at atmospheric pressure, into the chain 33 when door 28 is open and ashes 23 are dumped into the chute 33 to fall by gravity means into receptacle 19. The above mentioned air at atmospheric pressure, flows through openings 40, only when the foot pedal is pressed down to operate the vacuum producing means contained within diaphragm housing 12, which hereinafter will be described. A filter element 41 is provided and includes a plurality of openings 42 therethrough, which receive suitable screw fasteners 43, which are threaded into openings, not shown, in rear wall 35 of chute 33. Filter elements 41 serves to trap the ash dust produced when ashes 23 are dumped into chute 33, thus preventing the ash dust from entering the room in which device 10 is in. The abovementioned occurs when a vacuum is produced by the diaphragm 44 in housing 12, which causes a differential in pressure to exist in chute 33, by air being drawn out of flexible hose 45 and pipe 46. Pipe 46 is fixedly secured in a suitable manner, to the outside surface of wall 35, over opening 47 therein, at one end, and its opposite end is similarly secured over opening 48 through cover 24. The flexible hose 45 includes a coupling 49 at one end, which is fixedly secured in a suitable manner, to the outside surface of cover 24, over opening 48, and the opposite end of hose 45 includes a second coupling 50, suitably attached thereto, which is coupled to a check-valve 51, which is suitably fixedly secured to the top of diaphragm housing 12, and check-valve 51 is a one way valve which prevents air from traveling upward through hose 45 into chute 33. Air is drawn through check-valve 51, and through opening 52 through top wall is of diaphragm housing 12, when diaphragm 44 is pulled downward by means of foot pedal 41*a*, and it shall be noted, that pipe 46 is the rigid support means for rendering chute 33 secure within cover 24. However, if desired, further support means may be employed at the hinge 29 area of cover 24. Diaphragm 44 is circular in configuration and fabricated of a suitable rubber, and is fixedly secured at its outer peripheral edge in a suitable manner, to the inner periphery of housing 12 and an inner wall 12*a*, which is suitably fixedly secured to the top wall 18, the bottom plate 14, and the inner peripheral surface of housing 12. A plurality of equally and radially spaced coil springs 53, are fixedly secured in a suitable manner, to the bottom side of top wall 18, and to the top diaphragm 44, and serve as a means of pulling diaphragm 44 back to its normally up position, after being pulled downward by means of the foot pedal 41*a* mechanism.

A suitable cord or cable 54, is suitably fixedly secured at one end, to a center plate 55, which is suitably fixedly secured to the bottom surface of diaphragm 44, and cable 54 extends over a plurality of spaced rods 56, which are suitably fixedly secured to each end, at the inner periphery of housing 12. Rods 56 serve as support and bearing means against cable 54, and the opposite end of cable 54 is suitable secured to a projection 57, which is fixedly secured to the top of foot pedal 41*a*. Foot pedal 41*a* is pivotally secured to a hinge 58, which is also fixedly secured to the top of bottom plate 14, which extends outward from housing 12, and it shall also be noted, that openings 59 are provided through the wall of housing 12 and the inner wall 12*a*, for free movement of cable 54. A second check-valve 60 is fixedly secured to the exterior surface of housing 12 in a suitable manner, and is positioned over the opening 61 therethrough, which enables air to pass out of housing 12, but not in.

In operation, the upper grasps the handle 32 and opens the door 28. He than dumps ashes 23 into the chute 33. Most of the ash dust will travel to the top of dome shaped cover 24, and some will try to escape through opening 30 and into the room. However, as the ashes 23 drop from chute 33 into receptacle 19, the user steps on foot pedal 41*a* which by cable means 54, will pull diaphragm 44 downward, expelling the air underneath diaphragm 44, out of the vent openings 15. Simultaneously as the abovementioned occurs, the descending diaphragm 44 creates a vacuum above it, and a suction takes place in hose 45, pipe 46, filter element 41, and chute 33, and causes check-valve 60 to close and prevent air at atmospheric pressure from entering diaphragm 44. The result is, that a differential in pressure has been created and causes air at atmospheric pressure to enter openings 40 of chute 33, carrying the ash dust into the filter element 41, rather than letting such dust enter the room in which device 10 is located. When the foot pedal 41*a* is released, the diaphragm 44 is spring returned to its normal upward position, by means of the springs 53, and as this occurs, the check-valve 51 closes and the trapped air above diaphragm 44 is released through the check-valve 60, thus enabling the cycle to be repeated when desired.

When the receptacle 19 is full, the user lifts the cover 24 of container 16 and removes the receptacle 19, and then disposes of the ashes 23 therein.

It shall also be recognized, that the travel of the ash dust in chute 33, is indicated by means of arrows 33*a*, and the downward travel of the ashes 23 into the receptacle 19, is indicated by means of the arrows 33*b*.

While various changes may be made in the detailed structure, such details will be within the spirit and scope of the present invention, as defined by the appended claims.

What is claimed is:

1. An ash container comprising: a base, a container secured to said base, a vacuum producing mechanism secured in said base, a chute secured in said container for receiving ashes removed from a woodstove or fireplace, a hose communicating said vacuum producing mechanism with the interior of said chute through a filter secured in said chute so that a vacuum is created in said chute and said filter retains ash dust and prevents said ash dust from traveling through the air on the outside of said container, and an ash receptacle received in said container and disposed below said chute.

2. The combination as set forth in claim 1, wherein said base comprises a diaphragm housing which is fixedly secured at its rim edge to a top surface of a bottom plate, and said vacuum producing mechanism includes a diaphragm which is fixedly secured at its outer peripheral edge to the inner peripheral surface of a side wall of said diaphragm housing and an inner wall secured in said diaphragm housing, and said inner wall is fixedly secured at its top, bottom and side peripheral edges to a top wall of said diaphragm housing, said bottom plate and the inner periphery of said side wall of said diaphragm housing, respectively, and said top wall of said diaphragm housing is integrally attached to said side wall of said diaphragm housing, and said diaphragm housing includes a plurality of spaced cut-out openings through said rim edge for the passage of air from beneath said diaphragm when said vacuum producing mechanism is operated.

3. The combination as set forth in claim 2, wherein said vacuum producing mechanism further includes a cable which is fixedly secured at one end to a center bottom portion of said diaphragm and is fixedly secured at its opposite end to one end of a foot pedal which is pivotally secured at its bottom surface to a hinge fixedly secured to said top surface of said bottom plate which projects outwardly beyond said diaphragm housing, and a plurality of spatially arranged coil springs are disposed in said diaphragm housing with each spring being secured at opposite ends to a top side of said diaphragm and to a bottom side of said top wall such that said foot pedal when pressed downward will pull said diaphragm downward by means of said cable and produce a vacuum and said diaphragm when moving downard pulls against the spring tension of said plurality of coil springs.

4. The combination as set forth in claim 3, wherein said cable is fed around the outer peripheries of a plurality of spatially arranged rods which are fixedly secured at their ends to said inner periphery of said diaphragm housing, and said rods provide bearing and support means for said cable, and said cable extends through an opening provided through said inner wall in said diaphragm housing and an opening provided through said side wall of said diaphragm housing outwardly to said foot pedal.

5. The combination as set forth in claim 4, wherein a first one-way check valve is fixedly secured over an opening provided through said top wall of said diaphragm housing, said hose is coupled to said first check valve at one end and is coupled at its opposite end to a coupling fixedly secured to a cover over an opening there in, said cover is secured to an upper open end of said container, said opening in said cover aligns with a pipe which is fixedly secured at one end to the inner surface of said cover over said opening and is similarly secured at its opposite end to a rear wall of said chute over an opening therein, and the filter is secured over the opening in said rear wall so that when said cable pulls said diaphragm downward, a vacuum is produced above said diaphragm and air is pulled through said filter.

6. The combination as set forth in claim 5, wherein said cover includes a door disposed over a second opening in said cover, said door being hinged to said cover, said second opening being disposed over an open end of said chute and said filter is removably secured to said rear wall on the interior of said chute by suitable screw fasteners and catches said ash dust from said ashes which are dumped into said chute when said door is opened.

7. The combination as set forth in claim 6, wherein said chute is in alignment with the second opening in said cover and said pipe is the support means for said chute within said container.

8. The combination as set forth in claim 7, wherein said chute includes a total of four walls, one of which is said rear wall, another is a front wall and a pair of side walls are fixedly secured to said rear wall and said front wall, and a plurality of spaced openings are provided through said side walls to vent air in said ash receptacle when said vacuum is created to pull the air through said filter.

9. The combination as set forth in claim 8, wherein a second one-way check valve is fixedly secured over a second opening through said top wall of said diaphragm housing so that after the vacuum ceases and said diaphragm returns to its normal upward position by the tension of said coil springs, said first check valve closes and simultaneously said second check valve opens and releases air trapped above said diaphragm.

* * * * *